US009163913B2

(12) United States Patent
Laporte et al.

(10) Patent No.: US 9,163,913 B2
(45) Date of Patent: Oct. 20, 2015

(54) GRAVITY-LOADED TARGET LAUNCHING MACHINE FOR ARCHERY

(75) Inventors: Jean-Michel Laporte, Biot (FR); Jean-Marc Fouques, Claviers (FR)

(73) Assignee: Laporte Holding, Biot (FR)

( * ) Notice: Subject to any disclaimer, the term of this patent is extended or adjusted under 35 U.S.C. 154(b) by 0 days.

(21) Appl. No.: 14/239,488

(22) PCT Filed: Aug. 7, 2012

(86) PCT No.: PCT/EP2012/065447

§ 371 (c)(1),
(2), (4) Date: May 27, 2014

(87) PCT Pub. No.: WO2013/023960

PCT Pub. Date: Feb. 21, 2013

(65) Prior Publication Data

US 2014/0318520 A1 Oct. 30, 2014

(30) Foreign Application Priority Data

Aug. 18, 2011 (FR) ..... 11 57409

(51) Int. Cl.
*F41J 9/30* (2006.01)
*F41J 9/18* (2006.01)
*A63B 69/40* (2006.01)

(52) U.S. Cl.
CPC . *F41J 9/30* (2013.01); *A63B 69/40* (2013.01); *F41J 9/18* (2013.01)

(58) Field of Classification Search
CPC ..... F41J 9/30; A63B 69/40
USPC ..... 124/6, 7, 8, 9, 42, 46, 47, 50
See application file for complete search history.

(56) References Cited

U.S. PATENT DOCUMENTS 488,827 A * 12/1892 Melius ..... 124/16
1,552,191 A * 9/1925 Bahlmann ..... 124/26

(Continued)

FOREIGN PATENT DOCUMENTS

FR 2587473 3/1987
GB 2223415 4/1990

(Continued)

OTHER PUBLICATIONS

International Search Report and Written Opinion from the European Patent Office dated Sep. 25, 2012, for International Patent Application No. PCT/EP2012/065447, filed Aug. 7, 2012, Applicant, Laporte Holding (10 pages).

*Primary Examiner* — Melba Bumgarner
*Assistant Examiner* — Alexander Niconovich
(74) *Attorney, Agent, or Firm* — McCracken & Gillen LLC

(57) ABSTRACT

The present invention concerns a machine for launching discoidal targets for archery, comprising a launch housing able to accept a first target, a launch device able to move at least partly in the launch housing and able to launch the first target from the launch housing, and a feed magazine able to store a plurality of second and third targets awaiting loading into the launch housing, characterized in that the feed magazine emerges in the launch housing level with the first target able to be accepted so that the second target is able to be held in the feed magazine by contact of the first target which at least partially opposes gravity.
The invention will find its application for automatically launching several targets one after the other in the air for competitions or archer training.

15 Claims, 4 Drawing Sheets

(56) References Cited

U.S. PATENT DOCUMENTS

Figure 1:
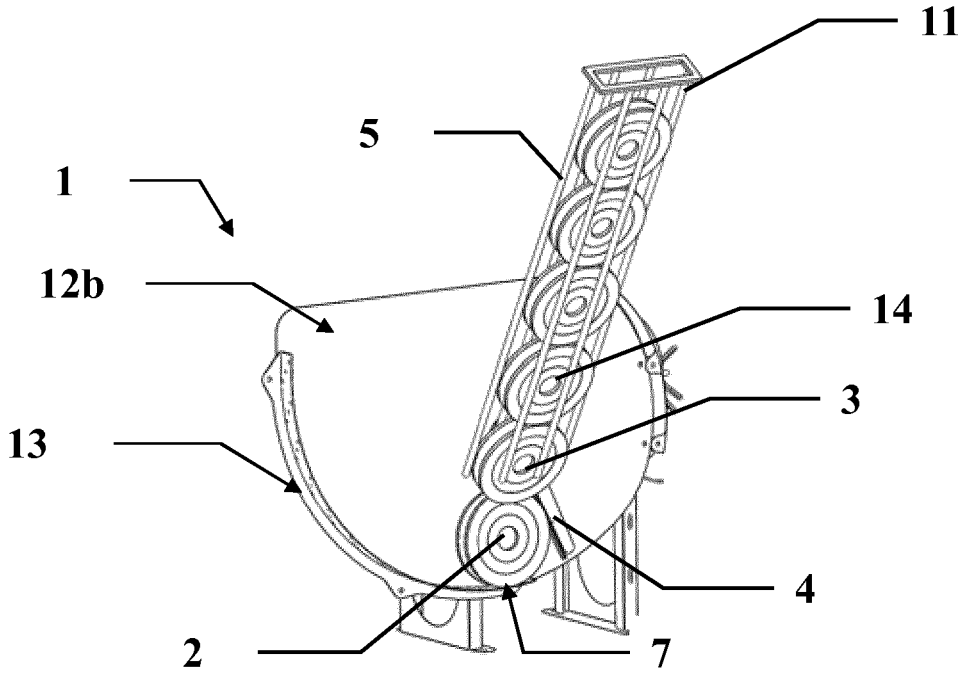
Figure 2:
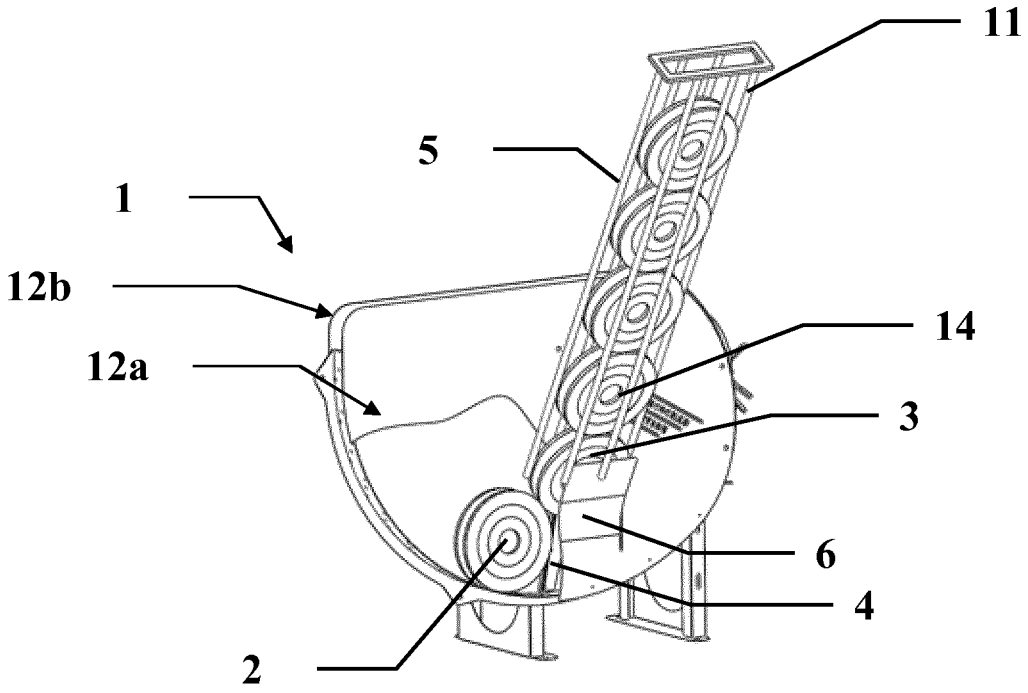
Figure 3:
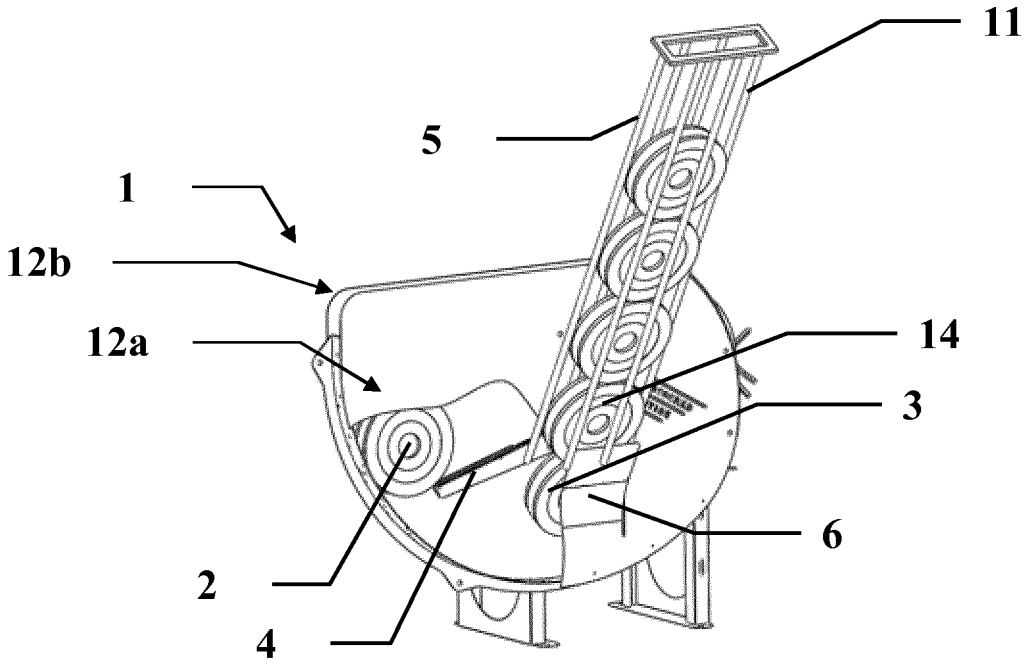

| | | | | | |
|---|---|---|---|---|---|
| 1,638,283 | A | * | 8/1927 | Bahlmann | 124/26 |
| 2,171,623 | A | * | 9/1939 | Connell | 124/8 |
| 2,469,016 | A | * | 5/1949 | Stopper | 124/47 |
| 2,531,613 | A | * | 11/1950 | Darrell | 124/8 |
| 3,093,127 | A | * | 6/1963 | Starr | 124/8 |
| 3,677,257 | A | * | 7/1972 | Segerkvist | 124/8 |
| 3,794,318 | A | * | 2/1974 | Holmes | 473/446 |
| 3,822,688 | A | * | 7/1974 | Mayne | 124/6 |
| 3,841,293 | A | * | 10/1974 | Laporte et al. | 124/8 |
| 4,747,390 | A | * | 5/1988 | Storm | 124/6 |
| 5,406,928 | A | * | 4/1995 | Panara et al. | 124/8 |
| 5,771,874 | A | * | 6/1998 | Kohler | 124/8 |
| 5,871,003 | A | * | 2/1999 | Laporte et al. | 124/9 |
| 5,937,839 | A | * | 8/1999 | Nilsson et al. | 124/8 |
| 6,431,161 | B1 | * | 8/2002 | Gustafsson | 124/8 |
| 6,588,410 | B1 | * | 7/2003 | Graber | 124/8 |
| 7,263,986 | B2 | * | 9/2007 | Lovell | 124/9 |
| 2006/0065258 | A1 | * | 3/2006 | Lovell | 124/9 |

FOREIGN PATENT DOCUMENTS

| | | |
|---|---|---|
| GB | 2234443 | 2/1991 |
| WO | 2011138336 | 11/2011 |

* cited by examiner

GRAVITY-LOADED TARGET LAUNCHING MACHINE FOR ARCHERY

The technical field of the invention is that of machines for launching targets for archery.

This discipline traditionally offers archers the possibility of shooting at fixed targets. A machine launching targets makes it possible to vary the training conditions by launching the targets in order to offer shooting at moving targets.

A launch machine comprises, in general terms, a launch housing able to accept a discoidal target. A launch device is able to launch a target from the launch housing. During the launch, the target rests, through its edge, on the launch device.

In order to be able to automatically launch several targets in a row without intervention by an operator, such a machine advantageously comprises a feed magazine able to store several targets. Said feed magazine is typically able to deliver one target at a time. In order to be able to be launched, a target delivered by the feed magazine must be loaded in the launch housing. The loading operation must be performed so as to be synchronised with a launch cycle so that the target is not loaded either too soon, with a risk of interfering with the launch of the previous target, nor too late, with a risk of reducing the launch rate.

These constraints may, in order to produce a means for transferring a target from a feed magazine to a launch housing, lead to solutions that are mechanically/kinematically complex or comprise a complex automatic control, which gives rise to expensive solutions that are subject to failure.

Machines for launching targets for shooting with firearms are known. In this case the targets are of the "clay pigeon" type and are produced from carbonates. The problem is then very different. In the event of a blockage of a target in the launch machine, it is easily broken, for example by the launch device, thus unblocking the machine. On the other hand, for archery, the targets are made from foam. They may more easily cause a blockage or jam. It is therefore necessary to produce target guidance and transfer means that do not risk creating such a blockage.

The invention proposes a solution not having the aforementioned drawbacks. The basic idea is the use of the weight of the target in order to achieve loading by gravity. In addition the target awaiting launch in the launch housing is advantageously used to retain the following target in the feed magazine and to control, when it is launched, the loading of the following target. The result is advantageously a launch machine not comprising any moving part or member, or any control means for performing the loading operation.

One object of the present invention is a machine for launching discoidal targets for archery, comprising a launch housing, preferably extending along a substantially vertical launch plane and able to accept a first target, preferentially in such a way that one face of the first target accepted coincides with said launch plane, a mobile launch device able to launch the first target from the launch housing, and a feed magazine able to store at least a second target awaiting loading into the launch housing, characterised in that the feed magazine emerges in the launch housing level with the first target able to be accepted so that the second target is able to be held in the feed magazine by contact of the first target which at least partially opposes gravity.

According to another non-limitative feature of the invention, the feed magazine is disposed at a height greater than the launch housing, so that a target delivered by the feed magazine is automatically loaded into the launch housing by gravity.

According to another non-limitative feature, the invention comprises a first target and a second target and a plurality of third targets, the targets each comprising two parallel faces and at least one circumference separating the two faces, the third targets being disposed in the feed magazine one after the other and up against each other through their circumferences.

According to another non-limitative feature of the invention, the launch housing extends along a substantially vertical launch plane able to accept a target, so that one face of the accepted target coincides with said launch plane.

According to another non-limitative feature of the invention, the feed magazine is able to deliver the second target in the launch housing by sliding of a face of the second target on a feed plane.

According to another non-limitative feature of the invention, the feed plane makes, with the launch plane, an angle less than or equal to 45° and preferably intersecting the launch plane in a horizontal straight line.

According to another non-limitative feature of the invention, said horizontal intersection straight line is situated below a high point of a first target accepted in the launch housing, at a distance of between 0 and $$\frac{e}{\sin\alpha}$$

from said high point, where e is the thickness of a target and $\alpha$ is the angle between the feed plane and the launch plane, so that the circumference of the target delivered by the feed magazine rests on a top edge of the target accepted in the launch housing.

According to another non-limitative feature of the invention, the angle between the feed plane and the launch plane is greater than or equal to 5°.

According to another non-limitative feature of the invention, the feed magazine emerges in the launch housing, preferably downstream of the launch device.

According to another non-limitative feature of the invention, the feed magazine is configured so that the circumference of the second target delivered by the feed magazine rests on a top edge of the first target accepted in the launch housing.

According to another non-limitative feature of the invention, the launch housing comprises two parallel faces spaced apart so as to receive a first target between them, the face is configured to form a guide stop able to limit and orient the movement of the second target so as to guarantee that the circumference of the second target delivered by the feed magazine rests on a top edge of the first target accepted in the launch housing.

According to another non-limitative feature of the invention, the launch housing and the feed magazine are sized so as to accept targets with a thickness of at least 5 centimeters, in order to guarantee that the circumference of the second target delivered by the feed magazine rests on a top edge of the first target accepted in the launch housing.

According to another non-limitative feature of the invention, the machine also comprises a feed spout, connecting the feed magazine to the launch housing, able to support and guide a target when it is loaded from the feed magazine into the launch housing.

According to another non-limitative feature of the invention, said feed spout has, in a vertical plane perpendicular to the launch plane, a curved profile continuously connecting the feed plane at the discharge from the feed magazine and the launch plane at the entrance of the launch housing, in order facilitate the tilting of a second target from an orientation parallel to the feed plane to an orientation parallel to the launch plane, when it is loaded in the launch housing.

According to another non-limitative feature of the invention, the feed magazine comprises a cylinder, with a cross section substantially in the form of a rectangle, said rectangle corresponding to the diametral section of a target, able to contain said plurality of targets, placed one above the other by their circumferences.

According to another non-limitative feature of the invention, said cylinder is produced in tubes, disposed parallel to the movement of the second and third targets during their loading, so that the contacts between the second and the third targets and the cylinder are reduced to lines parallel to the movement of the targets during loading.

Another subject matter of the invention concerns a method for distributing targets comprising the following steps: disposing a first discoidal target in a launch housing storing a plurality of discoidal targets in a feed magazine able to receive a second target at a lower end emerging close to the launch housing, characterised in that it comprises the steps of: holding the second target in the magazine by at least one abutment at its circumference on the circumference of the first target disposed in the feed housing; launch of the first target directly giving rise to the elimination of the holding of the second target in the feed magazine; sliding and positioning of the second target in the launch housing.

Figure 4:
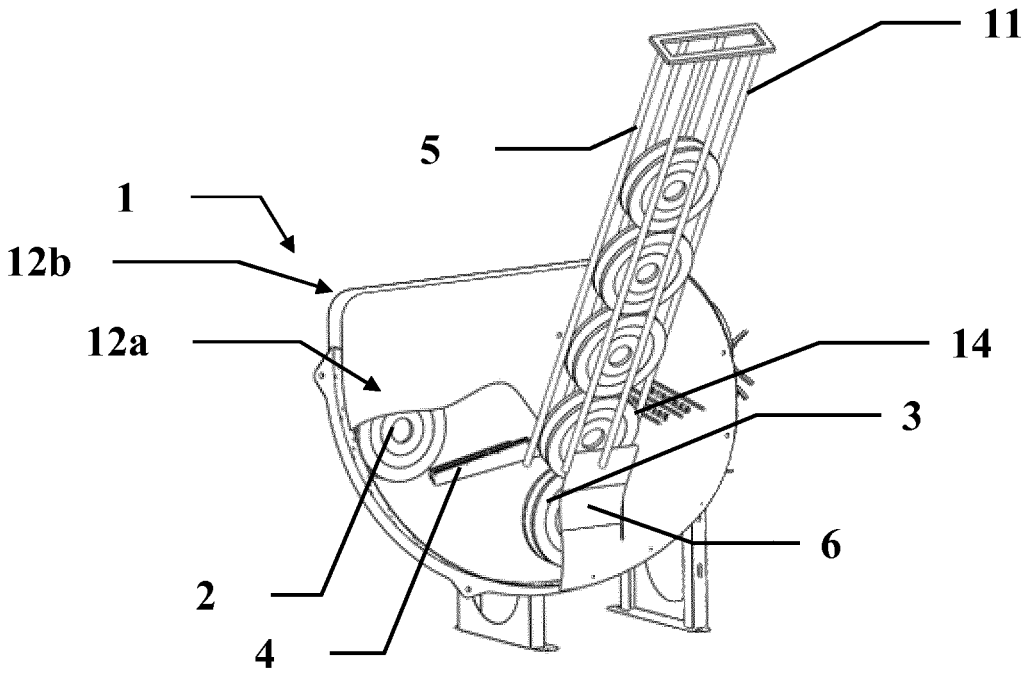
Figure 5:
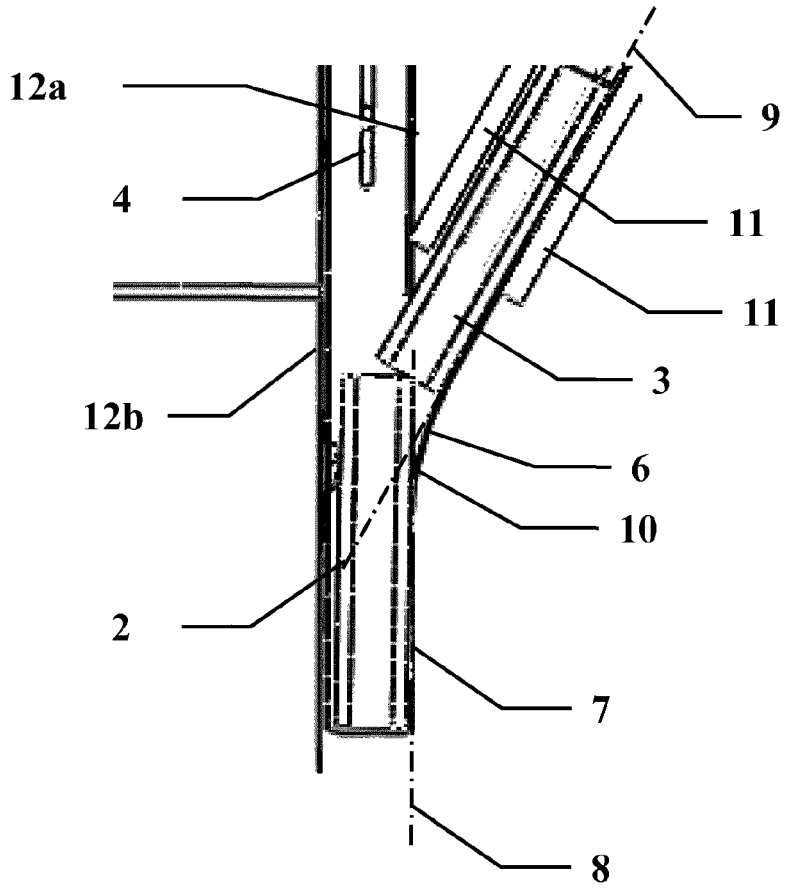
Figure 6:
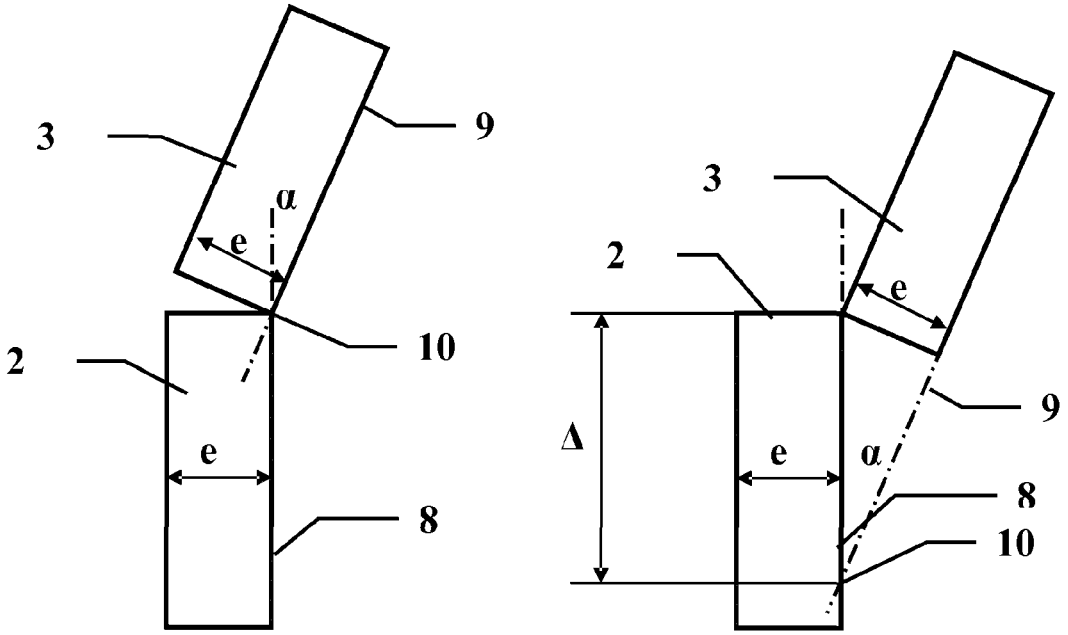
Figure 7:
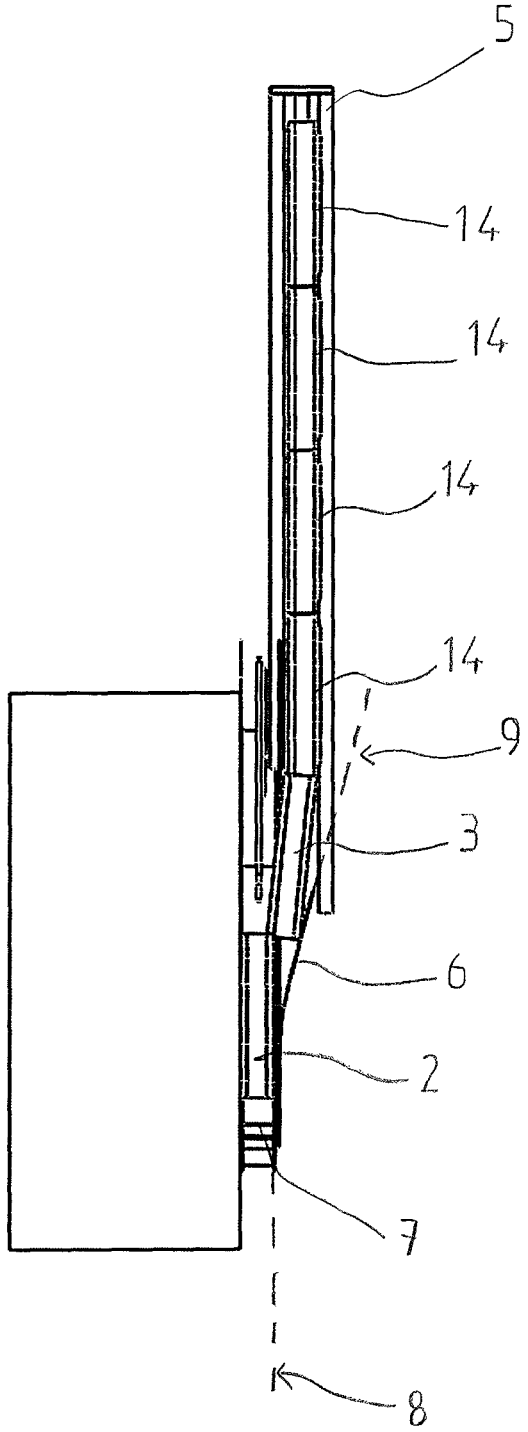

Other features, details and advantages of the invention will emerge more clearly from the detailed description given below by way of indication in relation to the drawings, on which:

FIGS. 1 to 4 present, in perspective view, an embodiment of a machine according to the invention in four successive steps during the launch of a target, FIG. 5 presents a detail view of the profile of the interface between the launch housing and the feed magazine, FIG. 6 illustrates extreme relative arrangements of the feed magazine relative to the launch housing, FIG. 7 illustrates another embodiment of the invention in which the feed magazine is vertical.

According to FIGS. 1 to 4, a machine 1 for launching discoidal targets 2, 3, 14 comprises a launch housing 7.

A target 2, 3, 14 is typically cylindrical and flattened. It has an essentially flat extension. In this plane, also referred to as the plane of the target, the target 2, 3, 14 is delimited by a circular cylindrical contour or circumference. In the direction perpendicular to said plane, the target 2, 3, 14 is delimited by two flat faces, distant by a thickness e. The target is produced from plastic foam, such as an elastomer foam. It may comprise two circular faces disposed on either side of a central body. The two circular faces are preferably formed from a material having a density lower than the central body in order to receive and hold the arrow at one of the two faces and blocking the passage of the arrow at the central body. The indicative dimensions of the target 2, 3, 14 are a diameter of 25 cm, and a thickness advantageously between 5 and 10 cm and preferentially 8 cm. The indicative weight corresponding to these dimensions is 100 grams.

The launch housing 7 accepts a first target 2 with a view to launch thereof. This launch housing 7 comprises two flat faces 12*a*, 12*b*, substantially parallel and spaced apart by the thickness e of a target 2, 3, 14 increased by a certain margin of tolerance, so that said target 2, 3, 14 can easily be placed in said launch housing 7 when loading, and then extracted during launch. These two flat faces are oriented so as to be substantially vertical when the machine is in operation. The flat face 12*a* disposed on the same side as the launch magazine 5 is also referred to as the launch plane 8.

The launch housing 7 also comprises a bottom 13 at the lower part, which comes under the circumference of the target 2 in order to vertically support the first target 2 against its weight. This bottom 13 may also comprise means for lateral positioning of the first target 2, such as here a curvature turned upwards, in order to determine a substantially repeatable position of the first target 2 relative to a launch device 4. The shape of the bottom 13 is also designed so as to control and plan the trajectory of the target once the latter is launched. After loading, the launch housing 7 accepts a first target 2, disposed vertically, with one of its faces substantially coinciding with the launch plane 8.

The launch device 4 is advantageously mobile, the movement of the launch device 4 is done at least partly in the launch housing 7. The launch device 4 comprises for example a rotary arm 4. The rotary arm 4 therefore moves at least over a portion of its rotation in the launch housing 7. FIG. 1 presents a machine 1, with a first target 2 loaded in place in the launch housing 7 and placed in front of the launch device 4. The launch device 4 describes a circular path, comes into contact with the first target 2 present in the launch housing 7, next pushes said first target 2 in front of it, during steps 2-3, in order to communicate a velocity to it. At the end of the path, as illustrated in FIG. 4, the first target 2 continues on its inertia and is launched out of the machine 1, while the launch device 4 continues its circular path, and returns to its initial position in FIG. 1, ready to launch the following second target 3, which has replaced the first target 2 in the launch housing 7, as will be described.

Once a first target 2 has been launched, it is necessary to reload the machine 1 by loading a second target 3 in the launch housing 7.

In order to be able to launch several targets 2, 3, 14 in a row without intervention by an operator, the machine 1 advantageously comprises a feed magazine 5. This feed magazine 5 is able to store a plurality of targets 3, 14 awaiting loading thereof into the launch housing 7. The feed magazine 5 advantageously contains a second target 3 and a plurality of third targets 14.

According to an advantageous feature of the invention, the feed magazine 5 is disposed at a height greater than the launch housing 7. Thus a second target 3 delivered by the feed magazine 5 can be loaded automatically into the launch housing 7, by gravity, simply under the effect of the weight of said target 3.

Preferentially, the feed magazine 5 emerges at its lowest end close to and preferentially directly level with the launch housing 7. Advantageously, at the area receiving the first target 2 to be launched. According to a preferred embodiment, the feed magazine 5 emerges downstream of the launch device 4. Downstream means relative to the direction of rotation of the launch device 4 and to the area where the launch device comes into contact with the first target 2 to be projected. This arrangement limits the risks of blocking of the launch device but runs counter to certain prejudices of the prior art tending to think that the stacking of the first target 2 to be launched and of the second target of the feed magazine 5 would block the movement of the launch device 4.

According to another important feature, the feed magazine 7 is able to deliver one target at a time. This delivery takes place by allowing a second target 3 to slide, preferably mainly under the effect of its weight, on a slide plane also referred as the feed plane 9. At the interface between the feed magazine 5 and the launch housing 7, the feed magazine 5 is such that it guides and delivers a second target 3 along said feed plane 9.

Preferentially, the targets 2, 3, 14 are stored in the feed magazine 5, one after the other, placed one above the other by their circumferences.

According to the invention, the targets 2, 3, 14 are disposed in the feed magazine 5 with one of their faces in abutment with the launch plane 9.

So that a gravity sliding can take place properly, said feed plane 9 advantageously forms a plane descending towards the launch housing 7 and forms with the launch plane 8 an angle $\alpha$ less than or equal 45°. Said angle $\alpha$ is measured around an intersection straight line 10 between the launch plane 8 and the feed plane 9, this straight line being a horizontal straight line 10.

For an angle $\alpha$ greater than 45°, the function of stopping the following target 3 against the first target 2 in place in the launch housing 7, described below, can no longer been ensured.

On the other hand, the smaller the angle $\alpha$, the better the fulfilment of the function of descent of the second target 3 by gravity in order to come to be placed in the launch housing 7. The more the angle $\alpha$ decreases, until it becomes zero, the more the orientation of the second target 3 along the feed plane 9 at the discharge from the feed magazine 5 approaches its final orientation, along the launch plane 8, in the launch housing 7, thus limiting its tilting movement and facilitating its positioning in the launch housing 7.

According to another advantageous feature, in that it eliminates any recourse to a means for sequencing the movements of the targets 2, 3, 14, a second target 3 is stopped in its descent and positioning in the launch housing 7, by the first target 2, as long as it is present in said launch housing 7. Once the first target 2 is launched, its absence allows and automatically controls the gravity descent of the second target 3, which is loaded into the launch housing 7, as soon as the latter is free. This guarantees optimum sequencing of the operations without any control device.

This is achieved, as long as a first target 2 is present in the launch housing 7, by a cooperation of the first target 2 with the second target 3. Thus the circumference of the second target 3 delivered by the feed magazine 5 comes to bear and rest on a top edge of the first target 2 still present in the launch housing 7, preventing the second target 3 from descending lower, and holding it in the feed magazine 5.

The condition for this abutment to be achieved is illustrated in FIG. 6. FIG. 6 presents the two extreme positions of the second target 3 with respect to the first target 2 between which it is guaranteed that the circumference of the second target 3 rests on a top edge of the first target 2. Each of these two extreme positions corresponds to a relative height of the feed magazine 5 with respect to the launch housing 7. This relative height is considered by the position of the feed plane 9 with respect to the launch plane 8. This amounts to considering the position in height of the intersection straight line 10 between the feed plane 9 and the launch plane 8. This position is considered relative to a reference position, advantageously a high point determined by a first target 2 in the launch position in the launch housing 7.

For the left-hand FIG. 6, the horizontal straight line 10 passes through the high point of the first target 2. The distance $\Delta$ in question is then zero.

For the right-hand FIG. 6, the horizontal straight line 10 passes below said high point, at a distance $\Delta$ equal to $$\frac{e}{\sin\alpha},$$

e being the thickness of a target 2, 3, 14 and $\alpha$ being the angle of inclination between the feed plane 9 and the launch plane 8.

This makes it possible to position the low outlet of the feed magazine 5 relative to the entry opening of the launch housing 7. An optimum positioning is at the middle between these two values, that is to say for a distance $\Delta$ equal to $$\frac{e}{2.\sin\alpha}.$$

The targets intended to be launched are typically lightened to the maximum possible extent. They thus usually have a small thickness e. Unlike this tendency of the prior art, the launch machine 1 according to the invention takes advantage of a use of thick targets 2, 3, 14 in order to improve the function of blocking of a second target 3 by a first target 2 in place in the launch housing 7. Thus a target 2, 3, 14 advantageously has a greater thickness than in the past. Consequently the launch housing 7 and the feed magazine 5 are advantageously sized so as to accept targets of at least 5 cm. This increases the chances that the circumference of the second target 3 delivered by the feed magazine 5 rests on a top edge of the first target 2 accepted in the launch housing 7.

The tolerance that guarantees this abutment is equal to $$\pm\frac{e}{2.\sin\alpha},$$

as seen previously, in the case of a centred mounting, that is to say with a distance $\Delta$ equal to $$\frac{e}{2.\sin\alpha}.$$

It is therefore clear that this tolerance increases with the thickness e of the targets 2, 3, and with a reduction in the angle $\alpha$. This tolerance is to be compared with the precision of positioning of a target 2, 3, 14, that is to say with the dimensional clearance between a second target 3 and the feed magazine 5 and/or between a first target 2 and the launch housing 7.

It was seen previously that an angle $\alpha$ as small as possible assists the movement of the second target 3 and the third target 14 in the feed magazine 5 and loading towards the launch housing 7. However, so that a second target 3 rests on a first target 2 through an edge rather than through the circumference, it is preferable for the angle $\alpha$ not to be zero. The angle $\alpha$ between the feed plane and the launch plane is advantageously greater than or equal to 5°.

Such an angle also allows offset between the feed magazine 5 and the launch housing 7. Said offset releases a space useful for the movement of the launch device 4.

According to one embodiment, the orientation of the feed plane 9 is common to the spout 6 and the feed magazine 5, as illustrated in FIGS. 1 to 5.

According to another embodiment illustrated in FIG. 7, the orientation of the feed plane 9 is along the spout 6. The feed magazine 5 for its part is advantageously oriented along a substantially vertical plane. In general terms, the feed magazine 5 extends in this case along a plane parallel to the launch plane 8. This arrangement accentuates the effect of gravity while limiting the size of the machine.

An angle $\alpha$ of between 10° and 30° appears to be a good compromise between the two constraints of use of gravity and reduction of contact between the first target 2 and the second target 3 at one edge.

According to the invention, the face 12*a* of the launch housing 7 situated on the same side as the feed magazine 5 is configured so as to fulfil a role in the guidance of the target 3 to be delivered. As illustrated in FIG. 5, the face 12*a* of the launch housing 7 prevents the second target 3 from being taken away, at the time of its descent, directly into the launch housing 7 above the first target 2 to be launched. The face 12*a* forms a stop limiting the movement of the second target 3 to be delivered. The second target 3 does not risk coming into abutment through its circumference on the circumference of the first target 2. The risks of blocking the launch of the first target 2 and/or the movement of the launch device 4 are reduced.

It should be noted that the above offset limits the risk of the presence of a second target 3 in the path swept by the launch device 4 and thus reduces the risks of blocking/jamming of the machine 1 and facilitates the launch of a first target 2. The second target 3 is disposed, relative to the first target 2, so that it does not interfere in the volume swept by the launch device 4. Thus the second target 3 in no way interferes with the launch of the first target 2.

The reduction in the contact between the first target 2 and second target 3 at an edge makes the contact with the first target 2 substantially at one point. This reduces the risk of having a second target 3 interfering, by pressure or friction, with the launch of the first target 2. On the contrary, in the conformation of the machine 1 as described, the gravity abutment of the second target 3, and where applicable of the third targets 14, exerted on the circular circumference of the first target 2, produces, as soon as said first target 2 has begun its launch, a component in the direction of the launch path that contributes to said launch.

In particular, the movement of the first target 2 causes the rotation of the second target 3 on itself. The pressure of the second target 3 on the first target 2 contributes to the movement of the first target 2 by applying a horizontal component added to that exerted by the launch device 4.

Advantageously, the second target 3 to be delivered is disposed in the feed magazine so as to be in abutment at several points of the machine in order to distribute the forces. The second target 3 is in abutment on the edge of the first target 2. The feed magazine 5 is configured so that the second target 3 in abutment on the edge of the first target 2 is in contact on a zone less than or equal to half its surface area. This arrangement helps to allow the sliding of the second target 3 into the launch housing 7 without any risk of blocking even with a feed magazine that is only slightly inclined with respect to the horizontal.

When it is loaded, a second target 3 changes orientation from an orientation parallel to the feed plane 9 to a vertical orientation parallel to the launch plane 8. In order to facilitate this change in orientation, a machine 1 according to the invention advantageously comprises, at the interface between the feed magazine 5 and the launch housing 7, a feed spout 6 connecting the feed magazine 5 to the launch housing 7. Said feed spout 6 advantageously has, in a vertical plane perpendicular to the launch plane 8, a curved profile continuously connecting the feed plane 9 at the discharge from the feed magazine 5 and the launch plane 8 at the entry to the launch housing 7. Such a shape, for example cylindrical, facilitates the tilting of a target 3 from an orientation parallel to the feed plane 9 at the discharge from the feed magazine 5 to an orientation parallel to the launch plate 8 when it is loaded into the launch housing 7.

Such a shape supports said second target 3 during its loading by sliding and guides it when it is transferred from the feed magazine 5 into the launch housing 7. The abutment of the second target 3 on the spout 6 in the position illustrated in FIG. 5 advantageously takes place through a linear part of one of the faces of the second target 3. The latter is also in contact, through its circumference, with an edge of the first target 2.

A cylindrical or even circular cross section combined with a thickness e of the target facilitates the sliding and tilting of the second target 3. This is because the spout is configured so as to limit the contact of the second target 3 with the spout 6 to a line that is situated downstream of the centre of gravity of the second target 3.

Such a shape produces a launch housing 7 with a shape splayed upwards at its opening. Such a funnel shape assists the loading of the second target 3 while forming a means for final positioning by automatic centring of the second target 3, when it descends into the launch housing 7, by gravity.

The feed magazine 5 advantageously comprises a cylinder with a cross section substantially in the form of a rectangle. This rectangle is adapted to the rectangular shape of the cross section of a target 2, 3, 14 cut along a diameter with a certain dimensional margin in order to allow translational movement of the targets 2, 3, 14 along a generatrix of said cylinder. Said cylinder is able to contain a plurality of targets, disposed one on the other, superimposed through their circumference.

The generatrix of such a cylinder may be of any form. In order to ensure the successive descent of targets 3 and 14 by gravity, this form descends towards the launch housing 7 so that each third target 14 is disposed higher than the third targets 14 that are loaded before it. Likewise this form advantageously does not have excessively great variations in orientation of the targets. Likewise this form must advantageously not encounter the plane along which the launch device 4 develops. According to an embodiment illustrated in the various figures, said generatrix is rectilinear.

In order to simplify the design, to offer visibility of the second and third targets 3, 14, and to improve the gravity sliding of the second and third targets 3, 14, said cylinder is advantageously produced as tubes 11. These tubes 11 are advantageously disposed parallel to the movement of the second and third targets 3, 14 during their loading. Thus the contacts between the second and third targets 3, 14 and said cylinder are reduced to lines parallel to the movement of the targets 3, 14 during their descent towards an exit opening at the bottom of the feed magazine 5.

Although a preferred embodiment of the invention is described herein it must be clearly understood that the invention is not limited to this embodiment and that variations can be made within the scope of the following claims.

REFERENCES

1. Machine
2. First target
3. Second target
4. Launch device
5. Feed magazine
6. Spout
7. Launch housing
8. Launch plane
9. Feed plane

10. Horizontal straight line
11. Tubes
12*a*-12*b* Face of launch housing
13. Bottom
14. Third target

The invention claimed is:

1. A machine for launching discoidal targets for archery, comprising a launch housing having a launch plane able to accept a first target, a launch device able to move at least partly in the launch housing and able to launch the first target from the launch housing along the launch plane, and a feed magazine having a feed plane able to store at least a second target awaiting loading into the launch housing along the feed plane, wherein the feed magazine emerges in the launch housing at a level of the first target so that the second target is able to be held in the feed magazine and rests by contact on a top edge of the first target which at least partially opposes gravity, wherein the feed plane is disposed at an oblique angle relative to the launch plane.

2. A machine according to claim 1, comprising the first target, the second target and a plurality of third targets, the targets each comprising two parallel faces and at least one circumference separating the two faces, the third targets being disposed in the feed magazine one after the other and up against each other through their circumferences.

3. A machine according to claim 1, wherein the launch housing extends along a substantially vertical launch plane able to accept a target, so that one face of the accepted target coincides with said launch plane.

4. A machine according to claim 3, wherein the feed magazine is able to deliver the second target in the launch housing by sliding of a face of the second target on a feed plane.

5. A machine according to claim 4, wherein said feed plane makes, with the launch plane, an angle ($\alpha$) less than or equal to 45° and intersecting the launch plane in a horizontal straight line.

6. A machine according to claim 5, wherein said horizontal intersection straight line is situated below a high point of a first target accepted in the launch housing, at a distance ($\Delta$) of between 0 and $$\frac{e}{\sin\alpha}$$

from said high point, where e is the thickness of a target and $\alpha$ is the angle between the feed plane and the launch plane.

7. A machine according to claim 5, wherein the angle ($\alpha$) between the feed plane and the launch plane is greater than or equal to 5°.

8. A machine according to claim 1, wherein the launch housing comprises two parallel faces spaced apart so as to receive a first target between them, the face is configured to form a guide stop able to limit and orient the movement of the second target so as to guarantee that a circumference of the second target delivered by the feed magazine rests on a top edge of the first target accepted in the launch housing.

9. A machine according to claim 1, wherein the launch housing and the feed magazine are sized so as to accept targets with a thickness of at least 5 centimeters, in order to guarantee that a circumference of the second target delivered by the feed magazine rests on a top edge of the first target accepted in the launch housing.

10. A machine according to claim 1, comprising a feed spout, connecting the feed magazine to the launch housing, able to support and guide a target when it is loaded from the feed magazine into the launch housing.

11. A machine according to claim 4, comprising a feed spout, connecting the feed magazine to the launch housing, able to support and guide a target when it is loaded from the feed magazine into the launch housing wherein said feed spout has, in a vertical plane perpendicular to the launch plane, a curved profile continuously connecting the feed plane at a discharge from the feed magazine and the launch plane at an entrance of the launch housing, in order facilitate a tilting of a second target from an orientation parallel to the feed plane to an orientation parallel to the launch plane, when it is loaded in the launch housing.

12. A machine according to claim 1, wherein the feed magazine comprises a cylinder, with a cross section substantially in the form of a rectangle, said rectangle corresponding to a diametral section of a target, able to contain said plurality of third target, placed one above the other by their circumferences.

13. A machine according to claim 12, wherein said cylinder is produced in tubes, disposed parallel to the movement of the targets during their loading, so that the contacts between the targets and the cylinder are reduced to lines parallel to the movement of the targets during loading.

14. A method for distributing targets in a launch machine according to claim 1, comprising the following steps:

disposing a first discoidal target in a launch housing storing a plurality of discoidal targets in a feed magazine able to receive a second target at a lower end emerging close to the launch housing wherein it comprises the steps of:

holding the second target in the magazine by at least one support at a circumference on the circumference of the first target disposed in the feed housing launching of the first target directly giving rise to an elimination of the holding of the second target in the feed magazine;

sliding and positioning of the second target in the launch housing.

15. A machine for launching discoidal targets for archery, comprising a launch housing able to accept a first target having a first circumference, a launch device able to move at least partly in the launch housing and able to launch the first target from the launch housing, and a feed magazine able to store at least a second target having a second circumference awaiting loading into the launch housing, wherein the feed magazine emerges in the launch housing at a level of and forming an obtuse angle with the first target so that the second target is able to be held in the feed magazine by resting on the first target at a contact point between the first and second circumferences.

* * * * *